US006773658B1

(12) United States Patent
Leppänen et al.

(10) Patent No.: US 6,773,658 B1
(45) Date of Patent: Aug. 10, 2004

(54) CASTING MOULD FOR MANUFACTURING A COOLING ELEMENT AND COOLING ELEMENT IN SAID MOULD

(75) Inventors: Yrjö Leppänen, Pori (FI); Pertti Mäkinen, Pori (FI); Matti Salminen, Nakkila (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/889,942

(22) PCT Filed: Jan. 27, 2000

(86) PCT No.: PCT/FI00/00054

§ 371 (c)(1),
(2), (4) Date: Oct. 15, 2001

(87) PCT Pub. No.: WO00/45978

PCT Pub. Date: Aug. 10, 2000

(30) Foreign Application Priority Data

Feb. 3, 1999 (FI) ..... 990198

(51) Int. Cl.[7] ..... C21B 7/10

(52) U.S. Cl. ..... 266/44; 266/193; 266/194

(58) Field of Search ..... 266/193, 194, 266/44

(56) References Cited

U.S. PATENT DOCUMENTS

| | | | | | |
|---|---|---|---|---|---|
| 3,763,302 | A | * | 10/1973 | Duchenoy et al. | 264/332 |
| 4,252,178 | A | * | 2/1981 | Hudd | 164/435 |
| 5,904,893 | A | * | 5/1999 | Stein | 266/193 |
| 6,280,681 | B1 | * | 8/2001 | MacRae | 266/193 |

FOREIGN PATENT DOCUMENTS

| | | | |
|---|---|---|---|
| GB | 1386645 | * | 3/1975 |
| GB | 1424532 | * | 2/1976 |

* cited by examiner

*Primary Examiner*—Scott Kastler
(74) *Attorney, Agent, or Firm*—Morgan & Finnegan, LLP

(57) ABSTRACT

The invention relates to a casting mould for manufacturing of a cooling element for a pyrometallurgical reactor, wherein the casting mould is at least partly cooled and lined with a material that can withstand high temperatures. The invention also relates to the cooling element made in the mould, inside which cooling pipes made of nickel copper are placed during fabrication.

7 Claims, 2 Drawing Sheets

Figure 1:
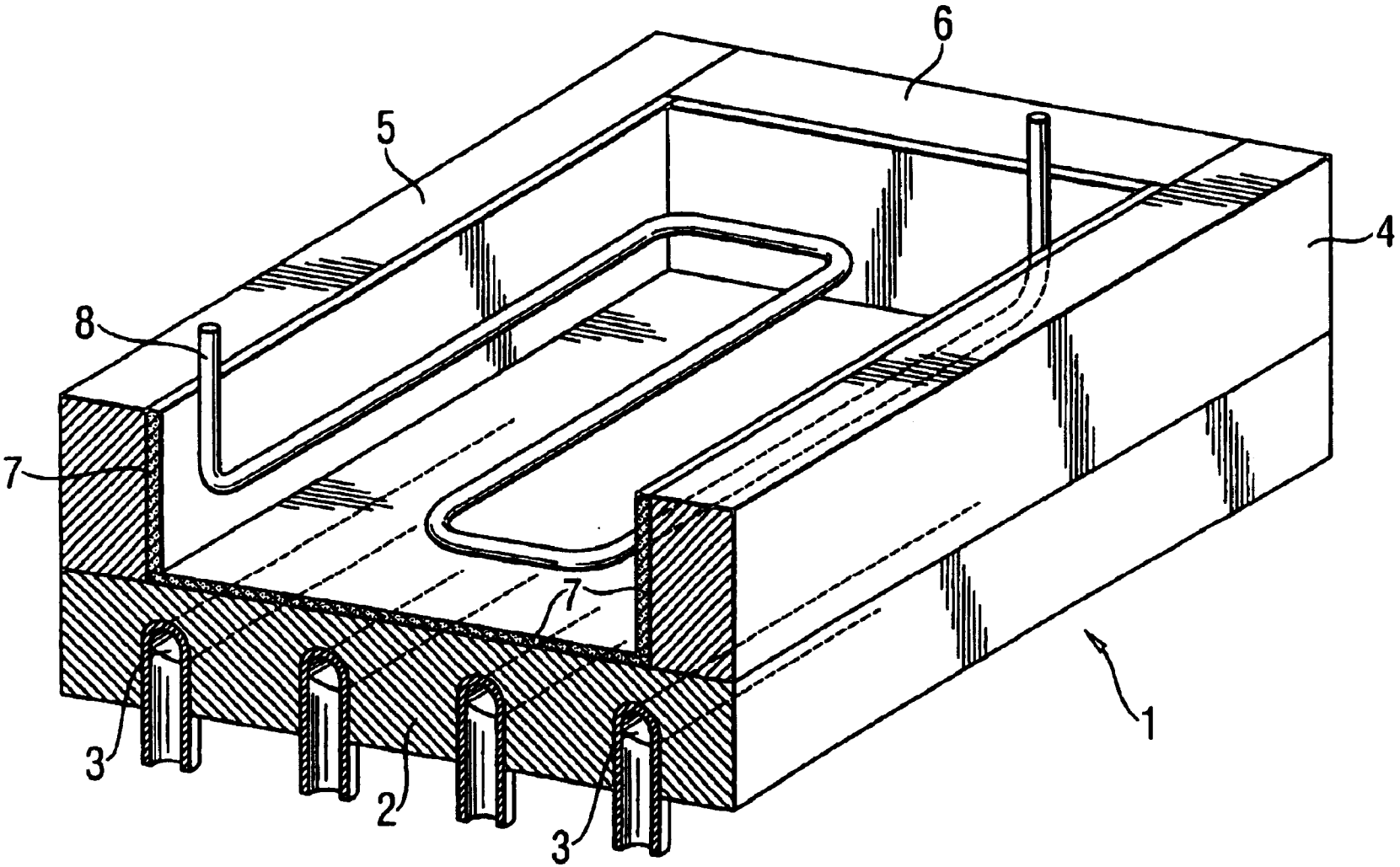

CASTING MOULD FOR MANUFACTURING A COOLING ELEMENT AND COOLING ELEMENT IN SAID MOULD

The invention relates to a casting mould for the manufacturing of a cooling element for a pyrometallurgical reactor, wherein the casting mould is at least partly cooled and lined with a material that can withstand high temperatures. The invention also relates to the cooling element made in the said mould.

In pyrometallurgical processes, the brickwork of a reactor is protected by water-cooled cooling elements so that, due to the cooling effect, the heat coming to the surface of the brickwork is transferred via the cooling element to water, wherein the wear on the lining decreases considerably in comparison with a reactor not provided with cooling. The decrease in wear is caused by the result of cooling, a so called autogenic lining, formed of slag and other molten phases that attaches to the fireproof surface of the lining.

Traditionally, cooling elements are manufactured by two methods: Firstly, the elements can be fabricated by sand casting. In this method, cooling pipes made of highly thermo-conductive material such as copper are set in a mould dug in the sand, so that during casting, there is cooling either by air or water occurring around the pipes. The element to be cast around the piping is also made of a highly thermo-conductive material, advantageously copper. This fabrication method has been described in for example GB patent 1386645. The problem with this method is the uneven attachment of the piping that acts as flow channel to the surrounding casting material, since part of the piping may be totally detached from the element cast around it and part of the piping may be completely melted and therefore damaged. If no metallic bond is formed between the cooling pipe and the other element cast around it, heat transfer will not be efficient. If the piping melts completely, it will prevent the flow of cooling water. The casting properties of the casting material can be enhanced by, for example, mixing some phosphorus into the copper, which will improve the metallic bond forming between the piping and casting material, but in this way the heat transfer properties (thermal conductivity) of the cast copper deteriorate considerably with just small additions. Advantages of this method can be listed as the comparatively low fabrication costs and independence from dimensions.

A fabrication method has also been used, where glass piping in the shape of a flow channel is set into the cooling element mould which glass piping is broken after casting, so that a flow channel forms inside the element. U.S. Pat. No. 4,382,585 describes another, widely used fabrication method for cooling elements, according to which the element is fabricated for example from rolled copper plate, by machining the necessary channels. The advantage of this method is the dense, strong structure and good heat transfer from a cooling medium such as water to the element. The drawbacks are dimensional limitations (size) and the high cost.

Now a casting mould has been developed for manufacturing a cooling element for a pyrometallurgical reactor to replace the previous sand casting. The casting mould is constructed from separate, highly thermo-conductive copper plates, of which at least some are water-cooled. Since the cooling element itself is in most cases copper, the construction plates of the casting mould should be isolated from the cast copper, and this occurs by lining the inner part of the mould with highly thermo-conductive material such as grapite plate, so that the parts of the mould attach themselves to the surface by means of underpressure. Graphite prevents the melt poured into the mould from sticking to the surface of the mould. The cooling element casting mould is advantageously provided with a cope, so the casting can be done in shielding gas. Prior to casting, the cooling pipes necessary for cooling water circulation that are going to go inside the cooling element are placed into the mould. This piping is preferably made of nickel copper pipe, because the melting point of Ni—Cu pipe is higher than the copper being cast around it and therefore there is no risk of the pipe melting during casting.

The essential features of the invention will become apparent in the attached patent claims.

The casting mould construction described in this invention offers the following advantages:

- Thanks to the cooled mould and graphite lining, a tight and fine-grained casting is formed, particularly at the base of the casting mould.
- The construction of the mould means that the cooling element forms a smooth surface, which is not vulnerable to corroding smelting conditions.

The nickel copper used as the material for the cooling element cooling pipes facilitates a good welding of the piping to the actual element.

The construction of the casting mould can be developed further so that it can also be used for manufacturing cooling elements designed for special purposes. This occurs for example by adding graphite or fireproof shaped pieces to the mould, so that the finished element design differs correspondingly from the plated version.

Figure 2:
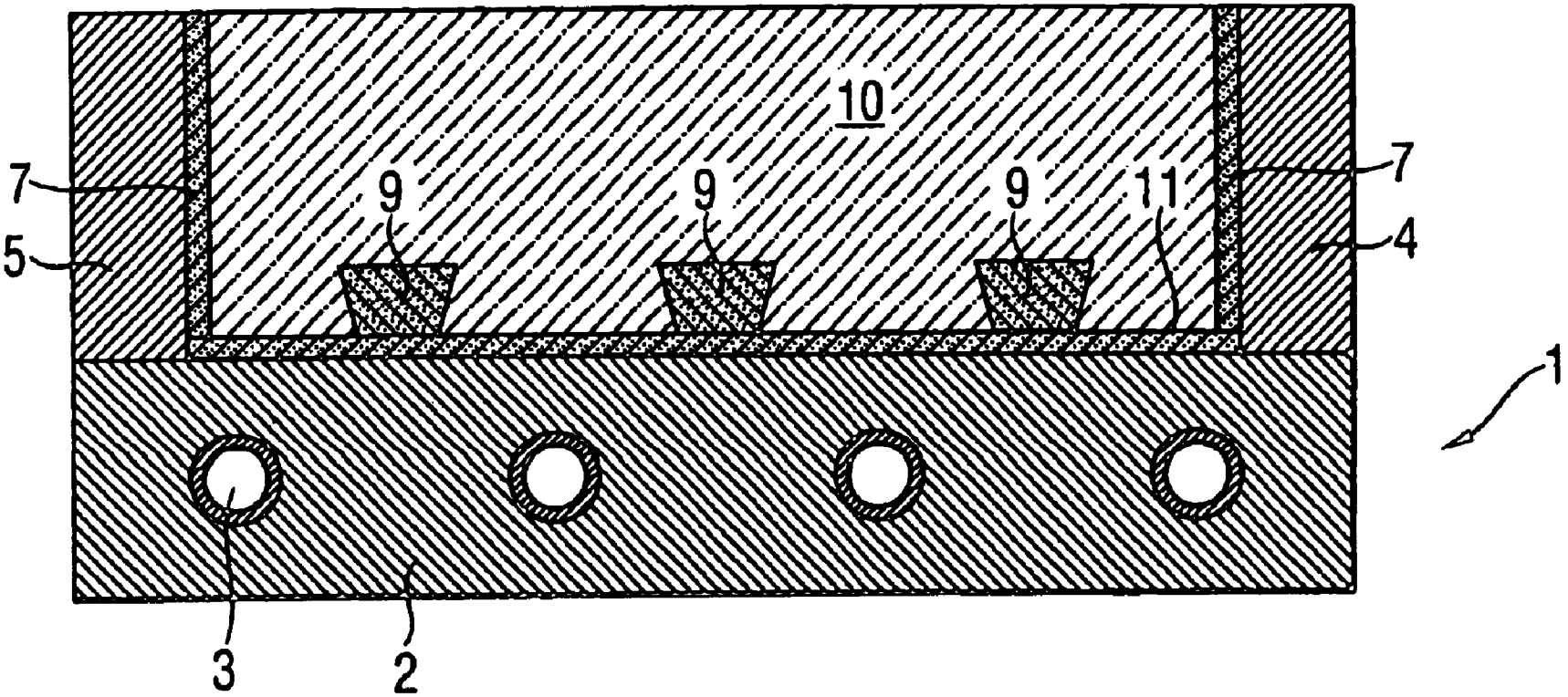

The invention can be described further with the aid of the attached diagrams, where FIG. 1 presents a principle drawing of the casting mould according to this invention and FIG. 2 shows the casting mould in cross-section, with which special-purpose cooling elements can be cast.

FIG. 1 shows a principle drawing of a cooling element casting mould 1. The mould is composed of a mould base plate 2, which is furnished with cooling pipes 3. The mould also has side walls 4 and 5 and end walls from which only a back wall 6 is shown in the drawing. In the drawing, only the base plate is furnished with cooling pipes but, if required, the side and end walls can also be equipped for cooling. The front end wall has been left out of the drawing for reasons of clarity, although it definitely belongs to the mould.

The inside of the mould is lined with graphite plates 7. The cooling element cooling pipes 8, which are advantageously made of nickel copper, are supported inside the mould. The mould is also equipped with a cope (not shown) so that shielding gas can be used to prevent oxidation of the element to be cast.

In FIG. 2 it can be seen that shaped pieces 9 can be placed on the base of the mould, which are made of graphite or some other fireproof material. By means of these shaped pieces, the side 11, which will come into contact with mould base 2 of cooling element 10, can be shaped as desired.

What is claimed is:

1. A casting mould formed of base wall and end plates for manufacturing a pyrometallurgical reactor cooling element, the casting mould made of copper plates is at least partly equipped with cooling pipes, the mould being lined on the inside with a plates resistant to high temperatures, the plates resistant to high temperatures being fixed to the surface of the mould by means of underpressure.

2. A casting mould according to claim 1, wherein the plates resistant to high temperatures are graphite plates.

3. A casting mould according to claim 1 wherein shaped pieces made of graphite or fire-resistant material are placed on the base of the casting mould.

4. The casting mould according to claim 1, wherein said cooling pipes are arranged within a base plate of the casting mould to provide cooling of the casting mould.

5. The casting mould according to claim 4, wherein said cooling pipes are additionally arranged within side and end walls of the casting mould to provide cooling of the casting mould.

6. The casting mould according to claim 1, further comprising a cope to retain a layer of shielding gas over the surface of the mould, which layer prevents excessive oxidation of molten material when the molten material is poured into the mould.

7. The casting mould according to claim 1, further comprising inserts placed into the cavity of the mould, the inserts being resistant to high temperatures and serving to create a corresponding negative shape in the cooling element to be cast.

* * * * *